US008096932B2

(12) United States Patent
Ifkovits et al.

(10) Patent No.: US 8,096,932 B2
(45) Date of Patent: Jan. 17, 2012

(54) SYSTEM AND METHOD FOR PROCESSING NESTED/UNNESTED MAILPIECE CONTENT MATERIAL

(75) Inventors: Michael R. Ifkovits, Danbury, CT (US); Edward M. Ifkovits, New Fairfield, CT (US); Daniel J. Williams, Woodbury, CT (US); Russell W. Holbrook, Southbury, CT (US); Adrian S Ruck, Norwalk, CT (US)

(73) Assignee: Pitney Bowes Inc., Stamford, CT (US)

( * ) Notice: Subject to any disclaimer, the term of this patent is extended or adjusted under 35 U.S.C. 154(b) by 179 days.

(21) Appl. No.: 12/341,629

(22) Filed: Dec. 22, 2008

(65) Prior Publication Data

US 2010/0156042 A1 Jun. 24, 2010

(51) Int. Cl.
*B31B 1/26* (2006.01)

(52) U.S. Cl. ..... 493/405; 493/408; 493/917; 53/569

(58) Field of Classification Search ..... 493/405, 493/408, 480, 917; 271/209, 182, 184, 233; 414/790.7; 270/58.06; 53/155, 154, 237, 53/569

See application file for complete search history.

(56) References Cited

U.S. PATENT DOCUMENTS 3,983,679 A * 10/1976 Zemke ..... 53/397
4,033,807 A * 7/1977 Neill et al. ..... 156/384
4,939,888 A * 7/1990 Katz et al. ..... 53/411
4,972,655 A * 11/1990 Ogawa ..... 53/155
5,156,384 A * 10/1992 Donahue ..... 270/58.31
5,681,035 A * 10/1997 Ifkovits et al. ..... 270/51
5,944,304 A * 8/1999 Branecky et al. ..... 271/2
5,947,461 A * 9/1999 Holbrock ..... 270/52.09
6,366,827 B2 * 4/2002 Krasuski et al. ..... 700/220
6,741,971 B1 * 5/2004 Duval et al. ..... 705/401
7,121,544 B2 * 10/2006 Masotta et al. ..... 271/209

* cited by examiner

*Primary Examiner* — Sameh H. Tawfik
(74) *Attorney, Agent, or Firm* — Brian A. Collins; Charles R. Malandra, Jr.; Steven J. Shapiro

(57) ABSTRACT

A system for processing nested/unnested content material in a mailpiece inserter includes a first accumulator, a second accumulator and a folding module disposed therebetween. The first accumulator is operative to feed individual sheets of content material, in one operating mode, and accumulate multiple sheets of content material in another operating mode. The second accumulator is operative to accumulate unnested, folded sheets of content material in one operating mode, and feed sheets of nested, folded sheets of content material in another operating mode. The folder interposes the first and second accumulators and is operative to (i) receive the individual sheets of content material from the first accumulator, fold the individual sheets, and feed the unnested, folded sheets to the second accumulator, in one of the operating modes, and (ii) receive the multiple sheets of content material from the first accumulator, fold the multiple sheets, and feed the nested folded sheets to the second accumulator, in the other of the operating modes. A system processor is operatively coupled to, and controls the operation of, the first accumulator, second accumulator and the folder in each of the operating modes.

4 Claims, 2 Drawing Sheets

SYSTEM AND METHOD FOR PROCESSING NESTED/UNNESTED MAILPIECE CONTENT MATERIAL

TECHNICAL FIELD

The present invention relates to a system and method for processing mailpiece content material, and more particularly, to a new and useful mailpiece inserter and method for using the same to process nested/unnested content material when creating mailpieces.

BACKGROUND OF THE INVENTION

Mailpiece creation systems such as mailpiece inserters are typically used by organizations such as banks, insurance companies, and utility companies to periodically produce a large volume of mailpieces, e.g., monthly billing or shareholders income/dividend statements. In many respects, mailpiece inserters are analogous to automated assembly equipment inasmuch as sheets, inserts and envelopes are conveyed along a feed path and assembled in or at various modules of the mailpiece inserter. That is, the various modules work cooperatively to process the sheets until a finished mailpiece is produced.

A mailpiece inserter includes a variety of apparatus/modules for conveying and processing sheet material along the feed path. Commonly mailpiece inserters include apparatus/modules for (i) feeding and singulating printed content material in a "feeder module", (ii) accumulating the content material to form a multi-sheet collation in an "accumulator", (iii) folding the content material to produce a variety of fold configurations such as a C-fold, Z-fold, bi-fold and gate fold, in a "folder", (iv) feeding mailpiece inserts such as coupons, brochures, and pamphlets, in combination with the content material, in a "chassis module" (v) inserting the folded/unfolded and/or nested content material into an envelope in an "envelope inserter", (vi) sealing the filled envelope in "sealing module" (vii) printing recipient/return addresses and/or postage indicia on the face of the mailpiece envelope at a "print station" and (viii) controlling the flow and speed of the content material at various locations along the feed path of the mailpiece inserter by a series of "buffer stations". In addition to these commonly employed apparatus/modules, mailpiece inserter may also include other modules for (i) binding/to close the module to close and seal filled mailpiece envelopes and a (vi) a printing module for addressing and/or printing postage indicia When producing mailpieces having multiple sheets, mailpiece inserters are commonly limited to producing content material which is "nested" when folded. That is, once multiple sheets of content material are accumulated, the collation is folded as a nested group. While this arrangement efficiently folds multiple sheets, plastic deformation along the fold lines can be difficult, resulting in a collation which adds unnecessary bulk to the mailpiece when loaded into an envelope. To address these concerns, additional folding modules or high capacity compaction rollers may be employed, however, such additional modules or equipment can increase the overall size of the mailpiece inserter. The overall space requirements or "footprint" of the mailpiece inserter is also challenged by the number of processing modules, e.g., buffer stations, needed to accommodate high speed inserters. As more buffer stations are displaced/added/needed, the size of the inserter can be adversely impacted.

A need, therefore, exists for a system and method for processing both nested and unnested content material while maintaining a minimum space envelop.

SUMMARY OF THE INVENTION

A system is provided for processing nested/unnested content material in a mailpiece inserter including a first accumulator, a second accumulator and a folding module disposed therebetween. The first accumulator is operative to feed individual sheets of content material, in one operating mode, and accumulate multiple sheets of content material in another operating mode. The second accumulator is operative to accumulate unnested, folded sheets of content material in one operating mode, and feed sheets of nested, folded sheets of content material in another operating mode. The folder interposes the first and second accumulators and is operative to (i) receive the individual sheets of content material from the first accumulator, fold the individual sheets, and feed the unnested, folded sheets to the second accumulator, in one of the operating modes, and (ii) receive the multiple sheets of content material from the first accumulator, fold the multiple sheets, and feed the nested folded sheets to the second accumulator, in the other of the operating modes. A system processor is operatively coupled to, and controls the operation of, the first accumulator, second accumulator and the folder in each of the operating modes.

DETAILED DESCRIPTION OF THE INVENTION

Figure 1:
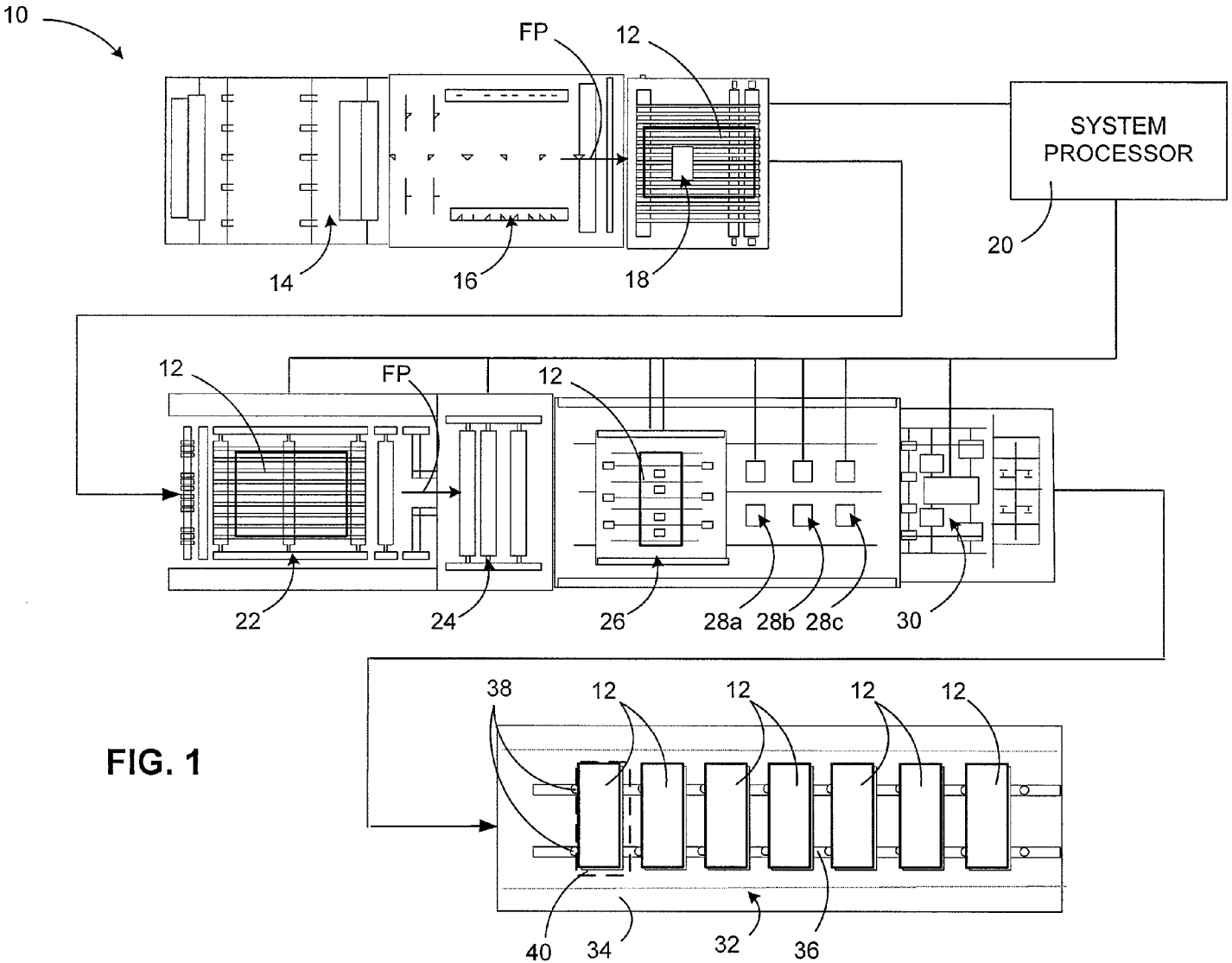
FIG. 1 is a schematic top view of a mailpiece inserter according to the present invention including input modules, a first dual accumulator, a second dual accumulator, a folder interposing the first and second dual accumulators, a plurality of buffer stations disposed downstream of the folder, a chassis module and an inverter disposed between the buffer stations and the chassis module.
Figure 2:
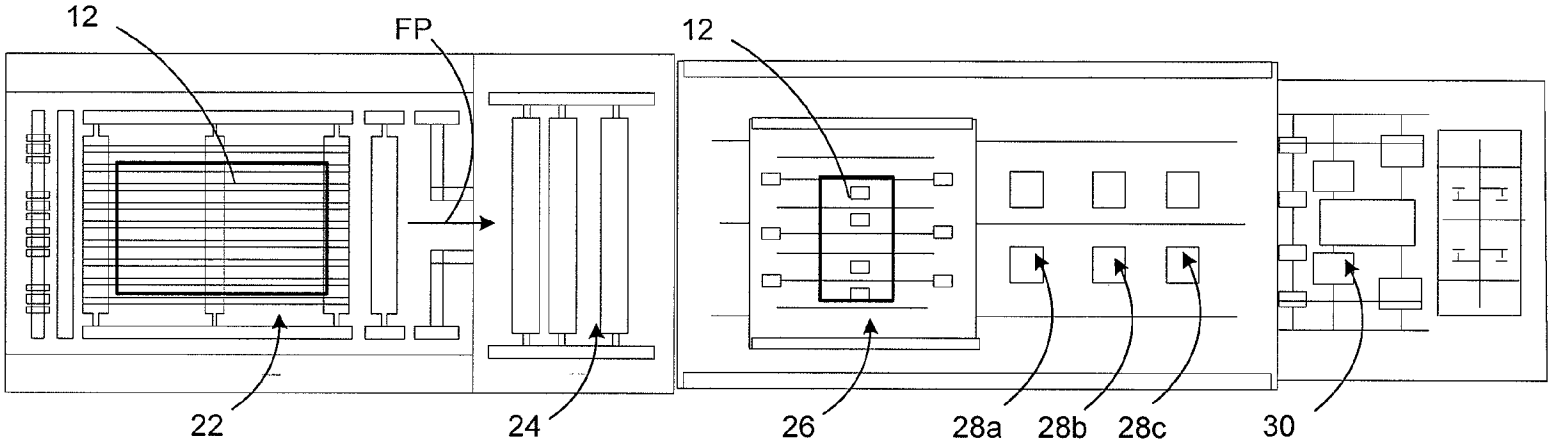
FIG. 2 is an enlarged schematic top view of the first and second dual accumulators, the folder, the buffer stations and the inverter.
Figure 3:
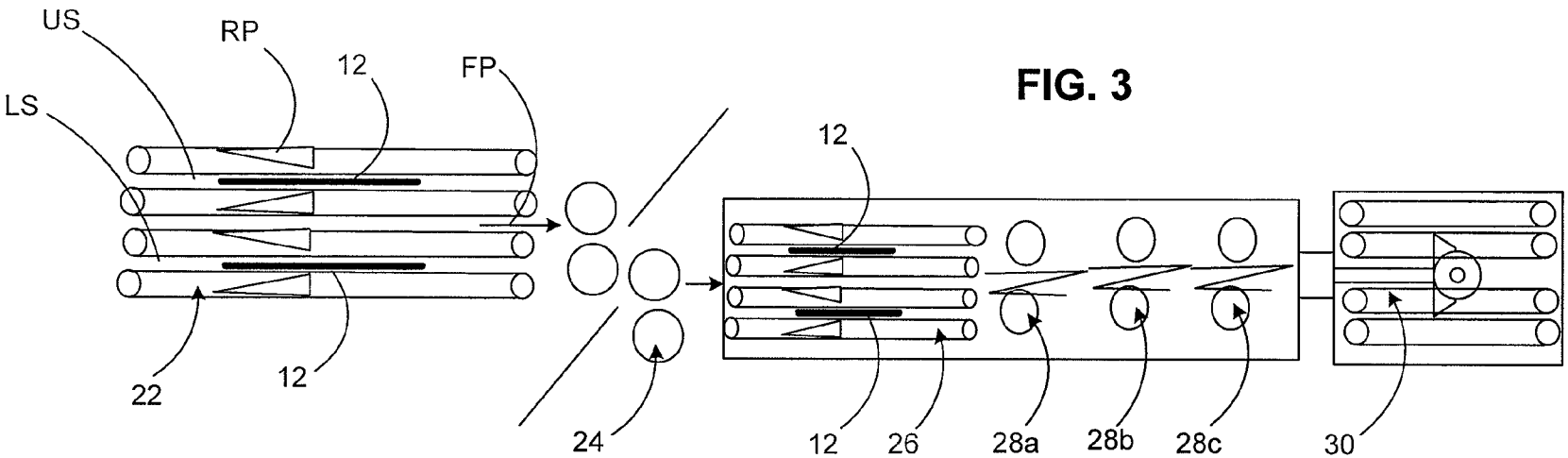
FIG. 3 is a schematic side view of the mailpiece inserter shown in FIG. 2.

The present invention is described in the context of a mailpiece inserter having a plurality of individual modules for processing sheet material and producing a mailpiece. FIGS. 1, 2 and 3 depict various stations/modules which are most relevant to the inventive system and method and, it should be borne in mind that a typical mailpiece inserter may include additional, or alternative, stations/modules other than those depicted in the illustrated embodiment. Therein, a mailpiece inserter 10 processes content material 12 to produce a mailpiece 14. In the described embodiment, the inserter 10 includes several input modules adapted to produce the sheets of content material 12. As used herein, the terms "content material" and "sheet material" are used interchangeably.

A rolled web 14 of printed content material is fed to a cutting module 16 where the printed content material 12 is cut to a dimension suitable for insertion into an envelope, e.g., letter or flats-type envelope. A scanner 18, or system for reading a scan code (typically located in the margin areas of the cut sheets), provides information to a system processor 20 regarding the number of sheets associated with an individual mailpiece. For example, the scan code may indicate that the next five (5) sheets from the rolled web 14 are to be assembled/processed to produce a mailpiece for delivery to a particular recipient address. Inasmuch as the sheets are cut into individual sheets, they must be combined at a station which accumulates or collects the sheets into a collation. As will be discussed in greater detail below, the collation may be individual sheets of content material which are initially folded and stacked one atop another (i.e., an unnested stack), or multiple sheets of content material 12 which are folded as a group (i.e., a nested stack).

The system of the present invention includes two (2) dual path accumulators, i.e., a first dual accumulator 22 disposed upstream of a folder 24, and a second dual accumulator 26 disposed downstream of the folder 24. Each of the dual accumulators 22, 26 includes a plurality of rings/belts disposed about rolling elements which function to convey sheet material along one of two paths, i.e., an upper staging area US or a lower staging area LS. Each of the staging areas US, LS accumulates the content material 12 by employing one or more ramps RP to collate the sheets in a top down or bottom up arrangement. When one of the staging areas US, LS receives all the content material 12 associated with one mailpiece, a diverter (not shown) directs the content material 12 associated with another mailpiece to the other of the staging areas US, LS. Each of the accumulators 22, 26, therefore, alternates between the upper and lower staging areas US, LS, thus producing dual paper paths for conveying content material 12. A dual accumulator of the type is described in commonly-owned U.S. Pat. No. 7,121,544 entitled "High Throughput Sheet Accumulator" issued to Masotta et al., and is included herein by reference in its entirety.

Depending upon the mode of operation selected, the first dual accumulator 22 is operative to feed individual sheets and/or accumulate multiple sheets of content material 12. Similarly the second accumulator 26 is also operative to accumulate and/or feed unnested and nested sheets of folded content material 12. By the term "feeding' is meant that the individual/multiple sheets and/or nested/unnested folded sheets may be passed through each of the accumulators 22, 26 without further processing, i.e., without "accumulating" sheets. "Accumulate" means that which is implied, i.e., that the first and second accumulators 22, 26 perform the function of stacking content material 12 associated with a particular mailpiece.

The folder 24 interposes the first and second accumulators 22, 26 and is operative to receive individual sheets and/or multi-sheet collations received from the first accumulator 22, fold the individual sheets and/or multi-sheet collations, and deliver the folded individual sheets (i.e., unnested individual sheets) or folded multi-sheet collations (i.e., nested stack of sheets) to the second accumulator 26. The folder 24 is capable of creating multiple fold patterns/configurations such as a C-fold, Z-fold, Bi-fold or gate-fold etc. Folders of the type described are discussed in commonly-owned U.S. Pat. No. 5,769,774 entitled "Folder with Recycling Feed Path" issued to Beck et al., and is included herein by reference in its entirety.

Downstream of the second accumulator 26 are other processing modules including an inverter 30, a chassis module 32 and a plurality of buffer stations 28*a*, 28*b*, 28*c* interposing the inverter 30 and the second accumulator 26. The inverter 30 is a device which changes the orientation of the content material from a face-up orientation to a face-down orientation. The inverter 30 performs this operation, as required, depending upon which face or panel must be presented for printing a destination or return address. An inverter 30 of the type described is discussed in commonly-owned U.S. patent application Ser. No. 11/508,429 entitled "Sheet Material Inverter" filed in the names of John Sussmeier et al., and is included herein by reference in its entirety.

The chassis module 32 includes a transport deck 34 (see FIG. 1) having longitudinal channels 36 formed therein for accepting and guiding a plurality of conveyance fingers 38. The fingers 38 project through the deck 34 and are arranged to form a plurality of rectangular pockets 40. Each pocket 40 accepts a packet of content material 12 associated with a single mailpiece which is then transported from one end of the chassis to the other. While being conveyed, one or more feeders (not shown) disposed above the deck 34 may dispense or add other inserts onto one or more of the packets of content material 12 below.

The buffer stations 28, 28*b*, 28*c* function as staging areas for the content material 12 and supply the chassis module 32 with sufficient content material to occupy each pocket 40 of the chassis module 32. That is, to optimize throughput, the buffer stations 28*a*, 28*b*, 28*c* are required to ensure that each pocket 40 of the chassis module 32 is filled based on a given conveyance speed. While the illustrated embodiment shows three dedicated buffer stations 28*a*, 28*b*, 28*c*, the system and method of the present invention reconfigures several upstream modules, i.e. the second accumulator 26 and the inverter 30, to function in the capacity of several additional buffer stations to optimize throughput without increasing the footprint of the inserter 10. This feature of the invention will be discussed in greater detail in subsequent paragraphs.

Inasmuch as the relevant modules of the inventive system and method are depicted in FIGS. 1, 2 and 3, other processing modules, i.e., downstream of the chassis module 32, such as an envelope insertion station, weigh station, and/or print station are not shown. It should be understood, however, that a conventional mailpiece inserter will include a variety of other downstream modules to perform various other sing steps.

The system and method of the present invention operates in various operating modes to process content material for insertion into mailpiece envelopes. In a first operating mode, the first accumulator 22 feeds individual sheets of content material to the folder 24, and the second accumulator 26 accumulates the folded sheets to form a stack of unnested content material. Hence, in this operating mode, the first accumulator 22 merely passes the content material 12 along the feed path to the folder 24, i.e., without further processing of the content material. Consequently, a stack of unnested content material 12 is created.

In a second operating mode, the first accumulator 22 accumulates multi-sheet collations, as required, for delivery to the folder 24, while the second accumulator 26 feeds the folded, multi-sheet collations to other downstream modules, e.g., the inverter 30 or chassis module 32. In this operating mode, the second accumulator 26 merely passes the content material along to the other downstream modules, e.g., the inverter 30 and/or chassis module 32. Further, this operating mode is consistent with conventional sheet material processing inasmuch as a nested stack of folded content material is produced.

In yet another operating mode, the first accumulator 22 feeds and accumulates content material, i.e., feeds individual sheets of content material 12 or accumulates multi-sheet collations, as required, while the second accumulator 26 feeds and/or accumulates folded content material (i.e., both nested and unnested sheets). Hence, the stack of content material 12 leaving the second accumulator may consist of a combination of nested multi-sheets and unnested individual sheets. As a result, this operating mode provides additional flexibility to produce mailpieces which present information in a distinctly different and useful manner.

In the first operating mode, individual sheets of content material 12 are folded and accumulated in the second accumulator 26. This stacking arrangement enables the fold lines of each individual sheet to be sharp or tightly formed. That is, the folder 24 is given the opportunity to fully or more completely deforming, i.e., plastically deforming, the content material 12 along the fold lines. As a result, the bulk of the content material 12 is reduced along with the thickness of the resulting mailpiece.

In the second operating mode, multi-sheet collations are folded in a nested stack in a conventional manner. While the inclusion of the second accumulator 26, which in this operating mode is merely conveying content material to the other downstream modules 28*a*, 28*b*, 28*c*, 30, 32, would nominally require additional space and increase the footprint of the mailpiece inserter 10, the inventors reconfigured the operation of the inserter 10 to mitigate its impact. That is, to maintain the original footprint of the inserter, the second accumulator 26 was integrated with the buffer station to function in dual capacities. Furthermore, inasmuch as the integration resulted in the loss of as many as three (3) buffer stations, both the accumulator 26 and inverter 30 was reconfigured to function as additional buffer stations. More specifically, each staging area US, LS of the second accumulator 26 is controlled to perform the function of a buffer station. As a result two buffer stations are recovered.

A third buffer station is recovered by reconfiguring the inverter 30. That is, inasmuch as the inverter 30 includes an operating mode wherein content material may pass directly through the inverter 30 without changing the orientation of the content material, the inverter 30 may be also be used as a staging area or buffer station for content material 12. As a result, the inverter includes a total of six (6) buffer stations, the three (3) dedicated buffer stations 28*a*, 28*b*, 28*c*, the two (2) staging areas US, LS provided by the second accumulator 26, and the additional one (1) staging area provided by the inverter 30.

In the third operating mode, the output or capability of both accumulators 22, 26 are utilized to feed and accumulate individual and multiple sheets of content material 12. In this operating mode, the stacked collations of unnested and nested content material may be combined to provide flexibility to produce mailpieces which present information in a distinctly different and useful manner.

It is to be understood that all of the present figures, and the accompanying narrative discussions of preferred embodiments, do not purport to be completely rigorous treatments of the methods and systems under consideration. For example, while the invention describes an interval of time for completing a phase of sorting operations, it should be appreciated that the processing time may differ. A person skilled in the art will understand that the steps of the present application represent general cause-and-effect relationships that do not exclude intermediate interactions of various types, and will further understand that the various structures and mechanisms described in this application can be implemented by a variety of different combinations of hardware and software, methods of escorting and storing individual mailpieces and in various configurations which need not be further elaborated herein.

The invention claimed is:

1. A system for producing content material having both nested and unnested folded sheets therein for a mailpiece inserter, comprising;

a first accumulator operative to feed individual sheets and accumulate multiple sheets of content material;

a second accumulator operative to feed and accumulate nested and unnested folded sheets of content material, the nested folded sheets including a folded accumulation of content material and the unnested folded sheets including an accumulation of individual folded sheets of content material;

a folder interposing the first and second accumulators and operative to (i) receive the individual sheets of content material from the first accumulator, fold the individual sheets, and feed the unnested, folded sheets to the second accumulator, and (ii) receive the multiple sheets of content material from the first accumulator, fold the multiple sheets, and feed the nested folded sheets to the second accumulator and a system processor operatively coupled to, and controlling the operation of, the first accumulator, second accumulator and the folder.

2. The system according to claim 1 wherein the second accumulator is a dual accumulator and wherein the system processor controls the operation of the dual accumulator to alternatively function as buffer stations for the mailpiece inserter.

3. The system according to claim 2 further comprising an inverter module disposed downstream of the second accumulator and wherein the system processor controls the operation of the inverter module to alternatively function as a buffer station for the mailpiece inserter.

4. The system according to claim 1 further comprising an inverter module disposed downstream of the second accumulator and wherein the system processor controls the operation of the inverter module to alternatively function as a buffer station for the mailpiece inserter.

* * * * *